US009985380B2

(12) United States Patent
Kwon et al.

(10) Patent No.: US 9,985,380 B2
(45) Date of Patent: May 29, 2018

(54) CONNECTOR AND POSITION ASSURANCE MEMBER RECEIVED THEREIN

(71) Applicant: Tyco Electronics AMP Korea Co. Ltd, Gyungsangbuk-do (KR)

(72) Inventors: Gi Chan Kwon, Gyungsangbuk-do (KR); Sung Jun Choi, Gyungsangbuk-do (KR); Young Kwon Ahn, Gyungsangbuk-do (KR)

(73) Assignee: Tyco Electronics AMP Korea Co. Ltd., Gyungsangbuk-Do (KR)

( * ) Notice: Subject to any disclaimer, the term of this patent is extended or adjusted under 35 U.S.C. 154(b) by 0 days. days.

(21) Appl. No.: 14/994,272

(22) Filed: Jan. 13, 2016

(65) Prior Publication Data

US 2016/0204539 A1 Jul. 14, 2016

(30) Foreign Application Priority Data

Jan. 13, 2015 (KR) ..... 10-2015-0006417
Jul. 14, 2015 (KR) ..... 10-2015-0099730

(51) Int. Cl.
*H01R 13/436* (2006.01)
*H01R 13/506* (2006.01)

(52) U.S. Cl.
CPC ..... *H01R 13/506* (2013.01); *H01R 13/4362* (2013.01); *H01R 13/4361* (2013.01)

(58) Field of Classification Search
CPC ..... H01R 13/4361; H01R 13/4362; H01R 13/436; H01R 13/4364; H01R 13/4365; H01R 13/4367; H01R 13/4368
USPC ..... 439/701, 752
See application file for complete search history.

(56) References Cited

U.S. PATENT DOCUMENTS 4,867,711 A * 9/1989 Yuasa ..... H01R 13/4362 439/744
5,358,431 A * 10/1994 Yamamoto ..... H01R 13/4368 439/595
6,790,073 B2 * 9/2004 Wu ..... H01R 12/85 439/495
2014/0301780 A1 * 10/2014 Tanikawa ..... H01R 13/42 403/376

FOREIGN PATENT DOCUMENTS

EP 1923962 A1 5/2008
EP 2779317 A1 9/2014
GB 2218272 A 11/1989
KR 1020120085051 A 7/2012

OTHER PUBLICATIONS

European Search Report, dated Jun. 15, 2016, 8 pages.
Abstract of KR 1020120085051, dated Jul. 31, 2012, 1 page.

* cited by examiner

*Primary Examiner* — Vanessa Girardi
(74) *Attorney, Agent, or Firm* — Barley Snyder

(57) ABSTRACT

A connector is disclosed. The connector comprises a cap having a first cable inserting hole, a coupling space recessed in the cap communicating with the first cable inserting hole, and a housing body including a housing lock. The connector also comprises a position assuring member received in the coupling space and fastened to the housing lock.

16 Claims, 12 Drawing Sheets

CONNECTOR AND POSITION ASSURANCE MEMBER RECEIVED THEREIN

CROSS-REFERENCE TO RELATED APPLICATIONS

This application claims the priority benefit of the filing date under 35 U.S.C. § 119 (a)-(d) of Korean Patent Application No. 10-2015-0006417, filed on Jan. 13, 2015, and Korean Patent Application No. 10-2015-0099730, filed on Jul. 14, 2015.

FIELD OF THE INVENTION

The present invention relates to a connector, and more particularly, to a position assuring member of a connector.

BACKGROUND

A connector is a type of electrical component that selectively allows or blocks electrical connection. In particular, a multipolar connector includes multiple input and output terminals installed at one end of a cable or a wiring harness to electrically connect controllers and a plurality of electronic units. The multipolar connector is manufactured in different shapes based on standards of cables being used and rated capacities of the electronic units. Commonly, a number of multipolar connectors to connect a variety of wiring harnesses must be assembled, which increases time and corresponding cost.

In view of the foregoing, Korean Patent Application Publication No. 10-2012-0085051 discloses a multipolar connector including a cap housing 10 including multiple terminals 15, a mating connector 30 fastened to the cap housing 10, and a retainer, for example, a locking portion 14, configured to stably fix the terminals 15 to ensure whether all the terminals 15 are at regular positions. The retainer is inserted into a side of the cap housing 10 and generally fixed through being locked twice.

A secondary locking of the retainer must be performed properly to stably maintain the terminals. However, in the aforementioned prior art, a function to detect an improper secondary locking is not provided, and thus, various types of quality issues arise. The secondary locking of the retainer is not detected properly due to a tolerance and a rounded shape of an edge portion of the retainer; a retainer may be inserted into a counterpart without being fastened to the cap housing. Improperly inserted terminals may be included in the completed product, which causes defects.

SUMMARY

An object of the invention, among others, is to provide a connector that may be easily and surely fastened. The disclosed connector comprises a cap having a first cable inserting hole, a coupling space recessed in the cap communicating with the first cable inserting hole, and a housing body including a housing lock. The connector also comprises a position assuring member received in the coupling space and fastened to the housing lock.

BRIEF DESCRIPTION OF THE DRAWINGS

The invention will now be described by way of example with reference to the accompanying figures, of which.

DETAILED DESCRIPTION OF EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
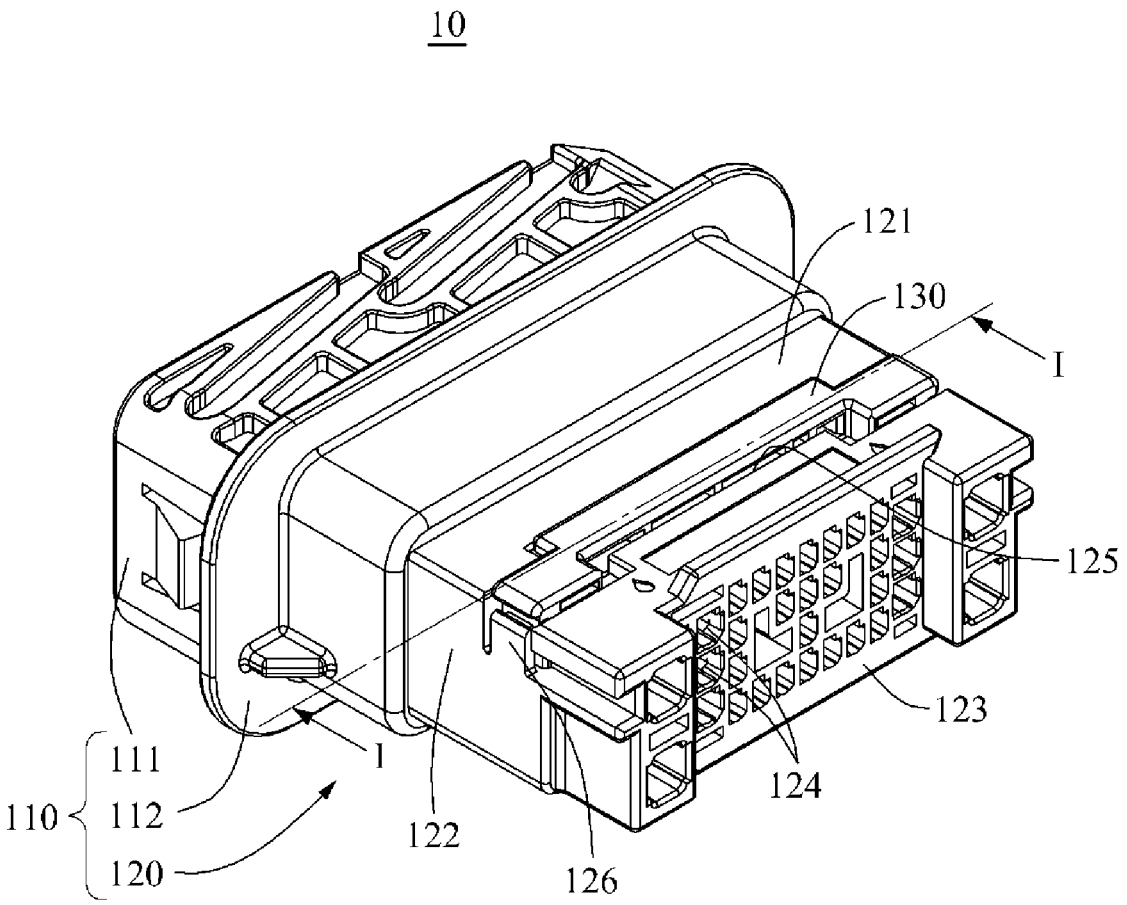
FIG. 1 is a perspective view of a connector according to an embodiment.

A connector 10 according to the invention is shown in FIG. 1. The connector 10 includes a cap 110, a housing body 120, and a position assuring member 130. The major components of the invention will now be described in greater detail.

The cap 110, as shown in FIG. 1, may include a plug fastening portion 111 to which the plug is to be fastened, a flange 112 disposed on one side of the plug fastening portion 111, and a housing body 120 into which the cable terminal is to be inserted.

The housing body 120 may be disposed on an opposite side of the plug fastening portion 111 from the flange 112. The housing body 120 may be roughly provided in a shape of a rectangular parallelepiped. Depending on positions, faces of the housing body 120 may be referred to as a front portion 121, a side portion 122, and a bottom portion 123, respectively. The housing body 120 may include a first cable inserting hole 124 into which the cable terminal is to be inserted, a coupling space 125 to which the position assuring member 130 is to be coupled, and a housing lock 126 configured to interfere with one side of the position assuring member 130 to prevent free movement of the position assuring member 130.

The first cable inserting hole 124 may be provided to penetrate through the bottom portion 123 in a vertical direction. The first cable inserting hole 124 may communicate with the coupling space 125. The cable terminal inserted into the first cable inserting hole 124 may be disposed in the coupling space 125. The coupling space 125 may be provided to be recessed in the front portion 121 and may communicate with the first cable inserting hole 124.

Figure 3B:
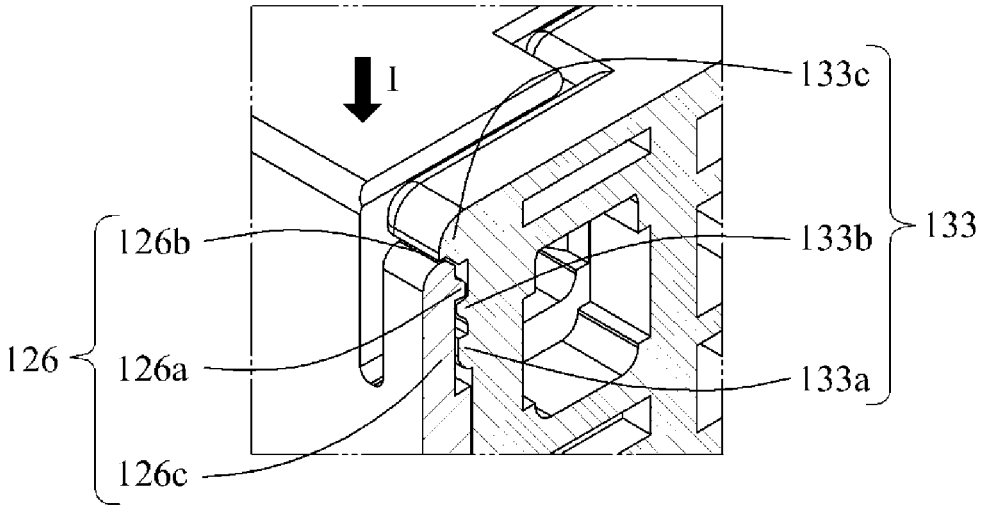
FIG. 3B is an enlarged view of a portion of FIG. 2, which illustrates a secondary locking state of a position assuring member according to an embodiment.
Figure 4A:
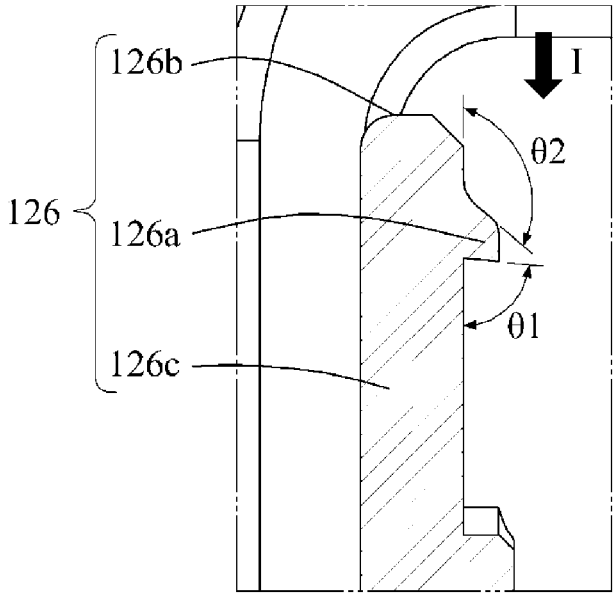
FIG. 4A is a view of a housing lock according to an embodiment.

The housing lock 126 may be provided in the side portion 122. As shown in FIGS. 3B and 4A, the housing lock 126 may include a locking protrusion 126*a*, a lock end portion 126*b* corresponding to a free end, and the bending portion 126*c*.

The locking protrusion 126*a* may be provided in a shape with an acute angle in a front portion and an obtuse angle in a rear portion relative to an inserting direction I of the position assuring member 130. For example, as shown in FIG. 4A, the locking protrusion 126*a* may be provided in a shape with θ1 of 85 degrees and θ2 of 125 degrees.

The bending portion 126*c* may be cantilever-shaped, as shown in FIG. 3B, such that one end portion of the housing lock 126 is fixed to the side portion 122, and another end portion of the housing lock 126 extends toward the front portion 121. The housing lock 126 may be formed using a method of cutting a portion of the side portion 122.

Figure 2:
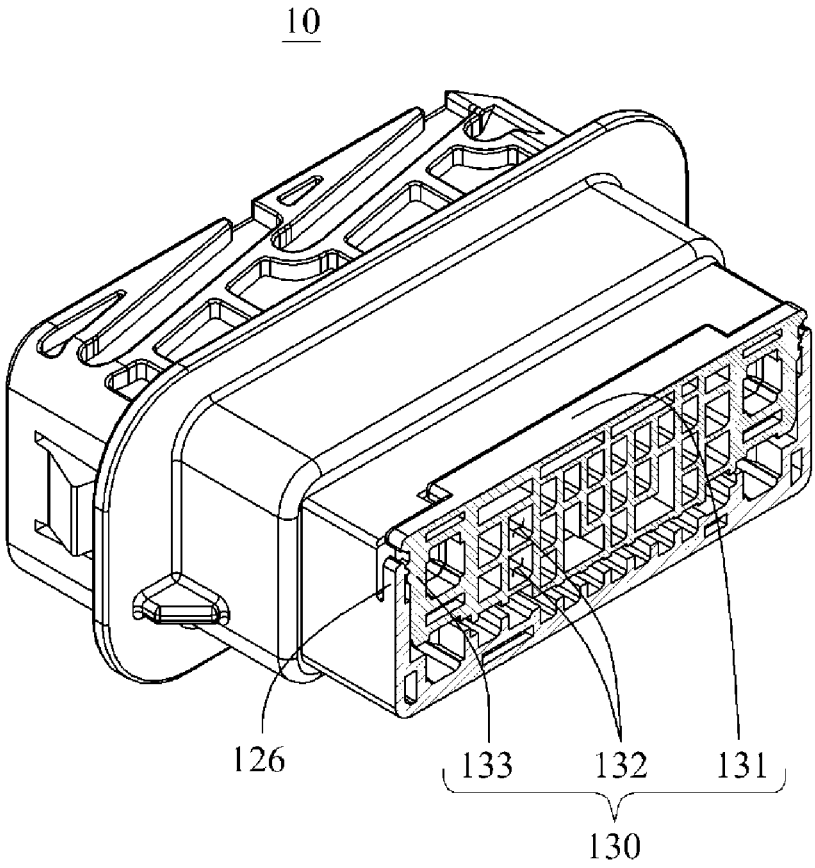
FIG. 2 is a cross-sectional perspective view of the connector of FIG. 1 cut along a line I-I.

The position assuring member 130, as shown in FIG. 2, may include a sliding body 131, at least one second cable inserting hole 132 provided in the sliding body 131, and an action portion 133.

The action portion 133 may be disposed on a side of the sliding body 131, and further may be provided on both sides of the sliding body 131. The action portion 133 may be provided in a shape to be engaged with the housing lock 126. The action portion 133 may include the plurality of protrusions, including a fixing protrusion 133*a*, a detaching protrusion 133*b*, and a cover 133*c*.

Figure 4B:
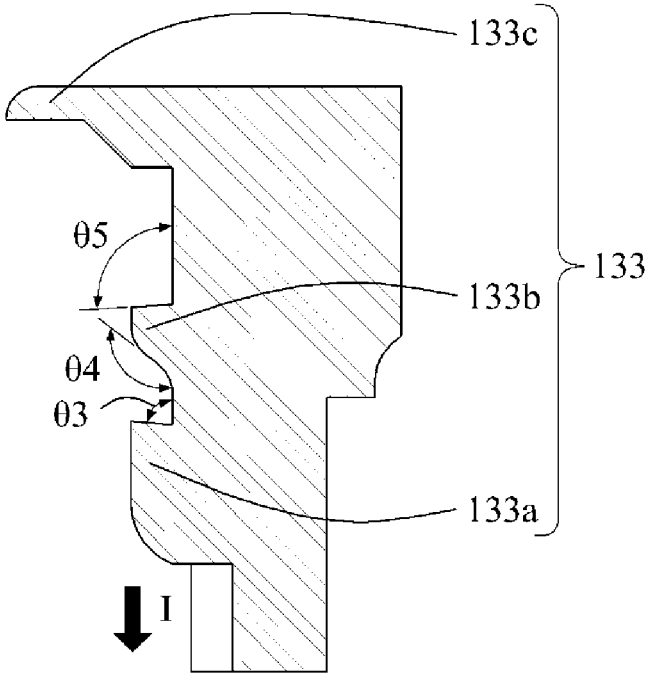
FIG. 4B is a view of an action portion according to an embodiment.
Figure 5:
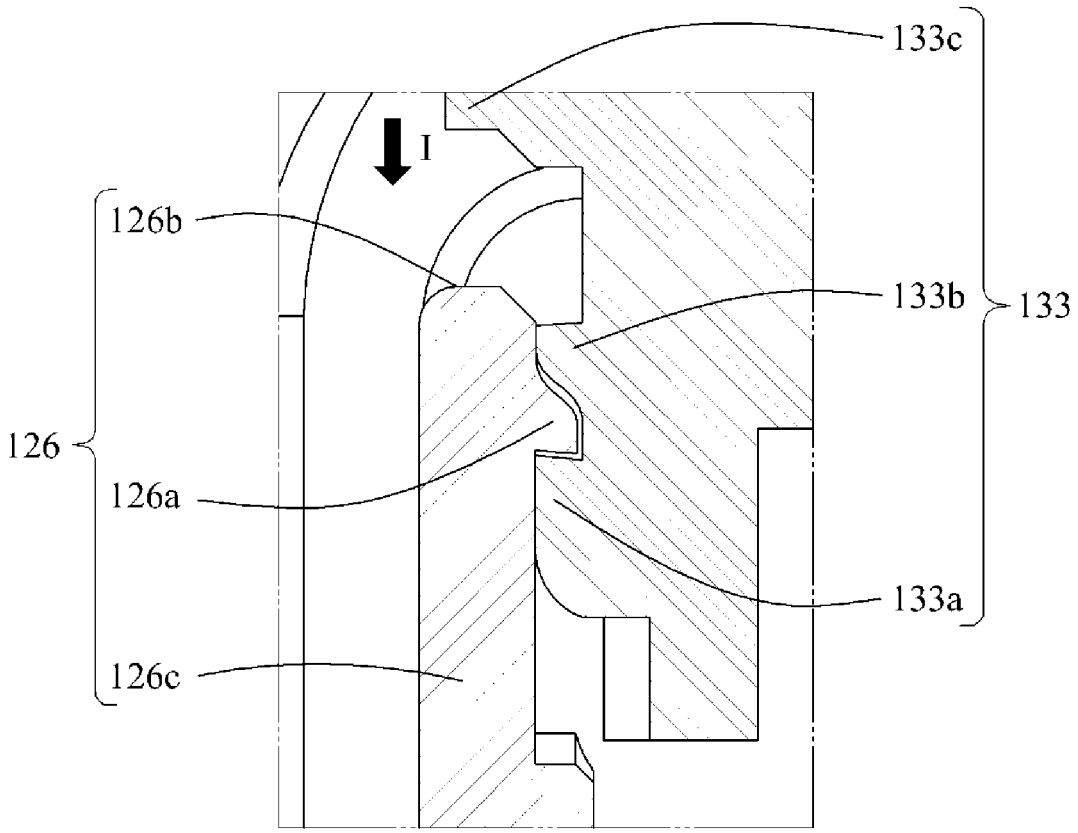
FIG. 5 is a view illustrating a housing lock and an action portion in a primary locking position according to an embodiment.

The fixing protrusion 133*a* may be disposed in front of the detaching protrusion 133*b*, relative to a direction in which the position assuring member 130 is inserted into the coupling space 125. The fixing protrusion 133*a* may be provided in a shape with an obtuse angle in a front portion and an acute angle in a rear portion relative to the inserting direction I of the position assuring member 130. For example, as shown in FIG. 4B, the fixing protrusion 133*a* may be provided in a shape with θ3 of 85 degrees.

The detaching protrusion 133*b* may be provided in a shape with obtuse angles in a front portion and a rear portion relative to the inserting direction I of the position assuring member 130. For example, as shown in FIG. 4B, the detaching protrusion 133*b* may be provided in a shape with θ4 of 125 degrees and θ5 of 95 degrees.

Referring to FIGS. 1 and 2, generally, the cap 110 may be fastened to a plug (not shown), and the position assuring member 130 configured to interfere with one side of a cable terminal inserted into the cap 110 to prevent the cable terminal from being pushed back.

More specifically, the position assuring member 130 may be slidingly coupled to the housing body 120. The sliding body 131 may be inserted into the coupling space 125, a second cable inserting hole 132 may accept insertion of the cable terminal, and the action portion 133, on a portion of an outer side of the position assuring member 130, may interfere with the housing lock 126. The housing lock 126 may be configured to interfere with both sides of the position assuring member 130. The locking protrusion 126*a* of the housing lock 126 may be selectively locked in one of a plurality of spaces formed by a plurality of protrusions provided in the action portion 133, thereby enabling the position assuring member 130 be locked at a plurality of positions.

Figure 3A:
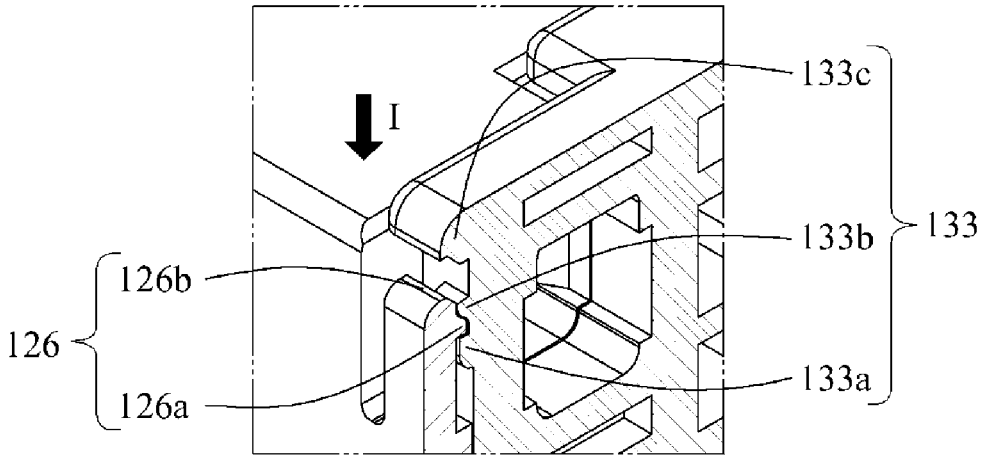
FIG. 3A is an enlarged view of a portion of FIG. 2, which illustrates a primary locking state of a position assuring member according to an embodiment.

As shown in FIG. 3A, a state of the position assuring member 130 being inserted by a first set length may be referred to as a primary locking state. In the primary locking state, the second cable inserting hole 132 may overlap the first cable inserting hole 124 relative to an inserting direction of the cable terminal for the cable terminal to be inserted thereinto.

As shown in FIG. 3B, a state of the position assuring member 130 being inserted by a second set length which is greater than the first set length may be referred to as a secondary locking state. In the secondary locking state, the second cable inserting hole 132 may overlap the first cable inserting hole 124, relative to the inserting direction of the cable terminal, such that a portion is misaligned. By the foregoing shape, the cable terminal may be inserted or separated through the first cable inserting hole 124 and the second cable inserting hole 132 in the primary locking state. Further, in the secondary locking state, the cable terminal may be fixed by the position assuring member 130. When the position assuring member 130 is secondarily locked while the cable terminal is being inserted into the housing body 120, the position assuring member 130 may be fit at a rear end of the cable terminal, thereby preventing a separation of the cable terminal. The cable terminal may thus be selectively locked in the coupling space 125 based on a position of the position assuring member 130.

Figure 6A:
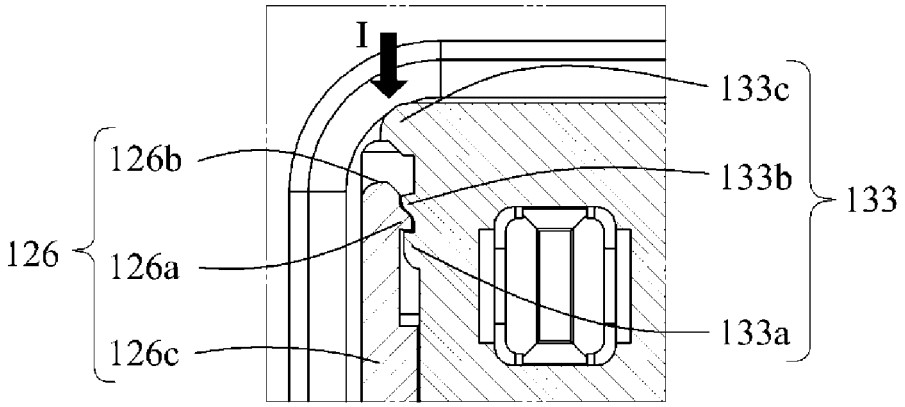
FIG. 6A is a view illustrating a cap and a position assuring member in a primary locking position according to an embodiment.
Figure 6B:
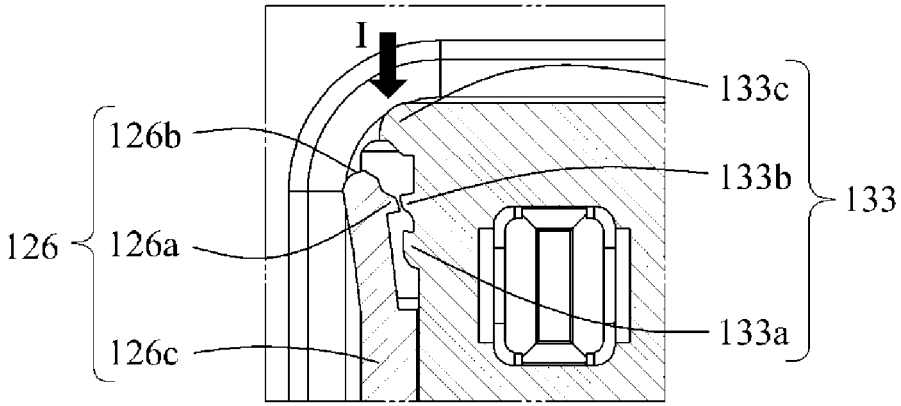
FIG. 6B is a view illustrating a cap and a position assuring member between a primary locking position and a secondary locking position according to an embodiment.
Figure 6C:
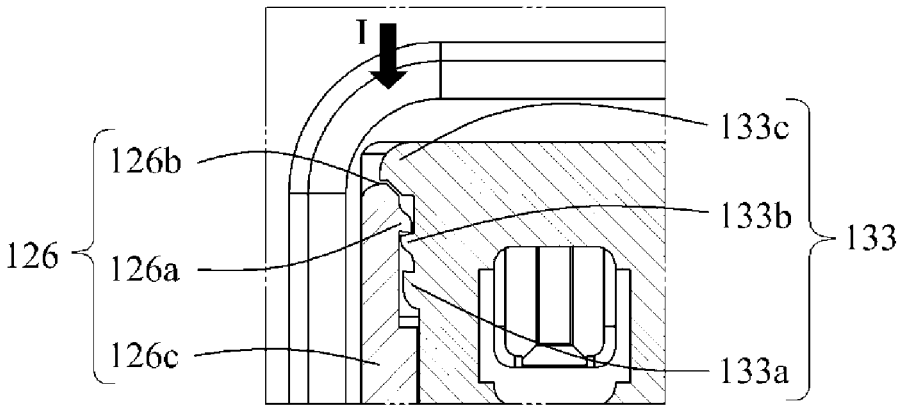
FIG. 6C is a view illustrating a cap and a position assuring member in a secondary locking position according to an embodiment.

FIG. 6A is a view illustrating the cap 110 and the position assuring member 130 being primarily locked according to an embodiment, FIG. 6B is a view illustrating the cap 110 and the position assuring member 130 switching between a primary locking state and a secondary locking state according to an embodiment, and FIG. 6C is a view illustrating the cap 110 and the position assuring member 130 being secondarily locked according to an embodiment.

Referring to FIGS. 6A through 6C, when the connector 10 is in the primary locking state or the secondary locking state, the housing lock 126 may not be bent. While the position assuring member 130 is moving between the primary locking state and the secondary locking state, the bending portion 126*c* of the housing lock 126 may be bent as shown in FIG. 6B, which indicates that the cap 110 and the position assuring member 130 are not perfectly fastened to each other. Thus, a worker may detect whether the cap 110 and the position assuring member 130 are properly fastened to each other, based on whether the housing lock 126 is bent.

In detail, the completely separated position assuring member 130 may be inserted into the cap 110. In this example, since contact portions of the fixing protrusion 133*a* and the locking protrusion 126*a* have obtuse angles on a side, as shown in FIGS. 4A and 4B, the fixing protrusion 133*a* may smoothly move over the locking protrusion 126*a*. Thus, the position assuring member 130 may be in the primary locking state as shown in FIG. 6A. Since both θ1 of the locking protrusion 126*a* and θ3 of the fixing protrusion 133*a* in FIGS. 4A and 4B are acute angles on the other sides of the protrusions, a separation of the position assuring member 130 from the coupling space 125 may be surely prevented in the primary locking state in which the front portion of the locking protrusion 126*a* is coupled to the rear portion of the fixing protrusion 133.

The position assuring member 130 may further proceed in the inserting direction I in the primary locking state. In this example, since contact portions of the detaching protrusion 133*b* and the locking protrusion 126*a* have obtuse angles, θ5 and θ2, respectively, the detaching protrusion 133*b* may smoothly move over the locking protrusion 126*a*. Thus, the position assuring member 130 may be in the secondary locking state as shown in FIG. 6C. While the position assuring member 130 switches from the primary locking state of FIG. 6A to the secondary locking state of FIG. 6C, the housing lock 126 may receive a force in an outward direction by the interference of the detaching protrusion 133*b* and the locking protrusion 126*a*. Accordingly, the bending portion 126*c* may be bent, and the housing lock 126 may protrude outward as shown in FIG. 6. The cover 133*c*, as shown in FIG. 6C, may cover the lock end portion 126*b* in the secondary locking state, and may prevent a separation of the separation preventing member 130 occurring when the housing lock 126 is bent by an unexpected external force.

Conversely, while the position assuring member 130 switches from the secondary locking state of FIG. 6C to the primary locking state of FIG. 6A, the housing lock 126 may receive a force in an outward direction by the interference of the detaching protrusion 133*b* and the locking protrusion 126*a*. Accordingly, the bending portion 126*c* may be bent, and the housing lock 126 may protrude outward as shown in FIG. 6B. Since θ5 is an obtuse angle, a separating force to be used to separate the position assuring member 130 from the coupling space 125 may be somewhat reduced in the secondary locking state in which the front portion of the locking protrusion 126*a* is coupled to the rear portion of the detaching protrusion 133*b*, also preventing crushing of the locking protrusion 126*a*.

Meanwhile, descriptions will be provided assuming a case in which the position assuring member 130 is temporarily in the secondary locking state of FIG. 6C when the position assuring member 130 is pressurized by the worker in the inserting direction I. In a case in which the cable terminal is not properly inserted even in the state of FIG. 6C, a reaction force may be received in a direction opposite to the inserting direction I, for example, in a direction in which the position assuring member 130 is separated outward by the cable terminal. In this example, the detaching protrusion 133*b* may provide a force in a direction in which the housing lock 126 spreads out since a portion of the detaching protrusion 133*b* which contacts the locking protrusion 126*a* is provided in a shape with an obtuse angle θ5. Accordingly, the housing lock 126 may protrude outward by the reaction force of the cable terminal, and the position assuring member 130 may return to the state of FIG. 6B or the state of FIG. 6A. In detail, when the cable terminal is not inserted properly, the position assuring member 130 may not be fastened properly. Thus, the worker may easily detect whether the cable terminal is inserted properly.

Figure 7:
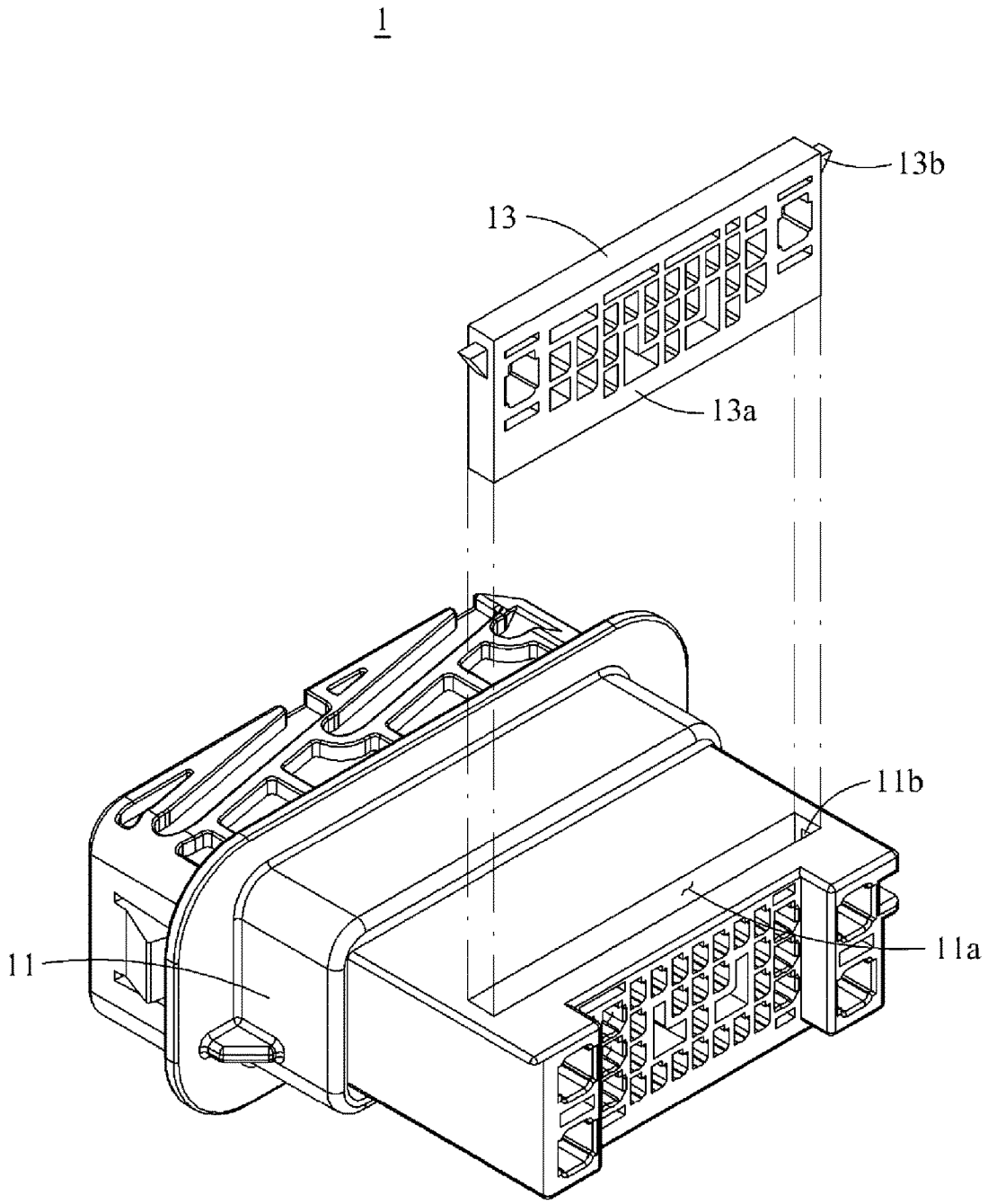
FIG. 7 is a view illustrating a connector according to another embodiment.
Figure 8:
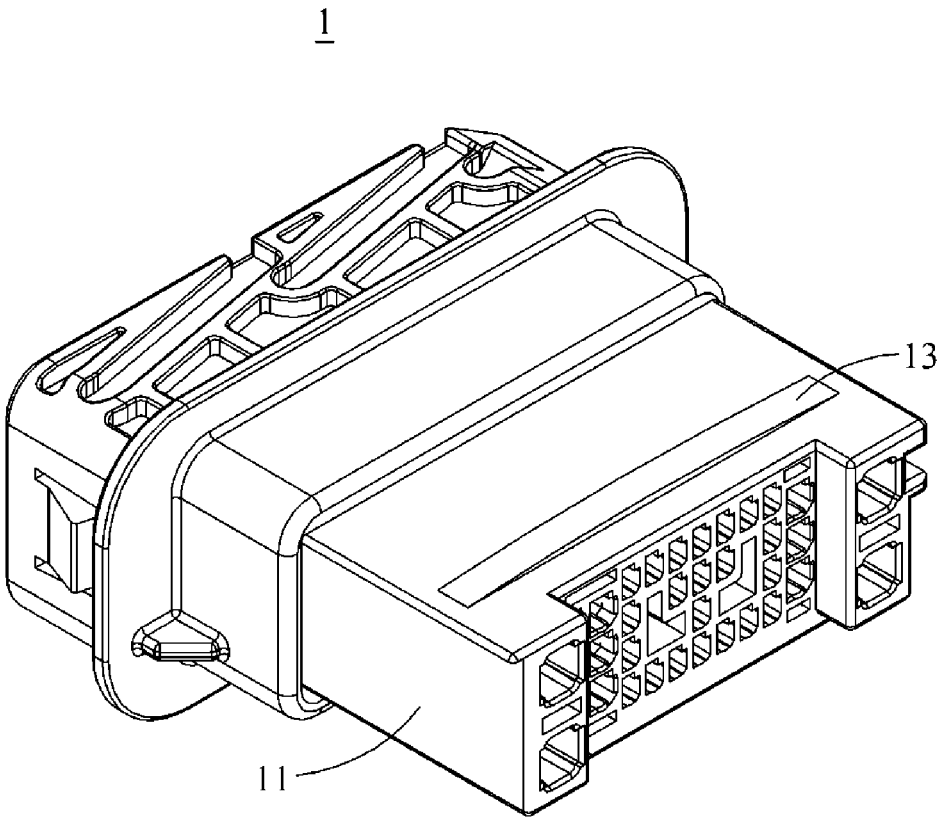
FIG. 8 is a view illustrating the connector of FIG. 7 in a defective fastening state.

An alternative embodiment is shown in FIGS. 7 and 8. Referring to FIGS. 7 and 8, the connector 1 may include a cap 11 including a coupling space 11*a* and a fastening recess 11*b*, and a position assuring member 13 may include a sliding body 13*a* and a fastening protrusion 13*b*. The sliding body 13*a* may be slidingly coupled to the coupling space 11*a*. In a resulting process, the fastening protrusion 13*b* may be fastened to the fastening recess 11*b*, thereby locking the position assuring member 13 in the cap 11.

When the position assuring member 13 is coupled to the cap 11 while a cable terminal is not inserted properly into the cap 11, the position assuring member 13 may not be inserted properly by interference of the cable terminal. In this example, in a structure of the fastening protrusion 13*b* and the fastening recess 11*b* as shown in FIG. 8, a central portion of the position assuring member 13 may be bent and protrude outward by the interference of the cable terminal when both sides of the position assuring member 13 are fastened to the cap 11.

Advantageously, according to embodiments, a position assuring member 130 may be locked in a cap 110 through a locking process. In the process of fastening the position assuring member 130 to the cap 110, a protrusion 126 provided in the cap 110 may be formed on a cantilever-shaped structure and thus, the cantilever-shaped structure may be smoothly bent. Damage to the protrusion 126, for example, crushing of the protrusion 126, may be prevented in a fastening or separating process, and accordingly, a lifespan of a connector assembly may increase. Further, when the position assuring member 130 is not fastened properly, the cantilever-shaped structure may be bent and protrude outward. A worker may visually verify whether the cantilever-shaped structure is bent and protrudes outward, thereby surely detecting whether the position assuring member 130 is fastened properly. Alternatively, when the position assuring member 13 is not fastened properly, the central of the position assuring member 13 may protrude outward, and a worker may verify whether the position assuring member 13 is fastened properly.

What is claimed is:

1. A connector, comprising:

a housing body having a cable inserting hole, a coupling space recessed in the housing body communicating with the cable inserting hole, and a housing lock; and a position assuring member received in the coupling space and having a sliding body and an action portion provided on one side of the sliding body, the action portion engaging the housing lock and having a detaching protrusion provided in a shape which forms obtuse angles in a front portion and a rear portion relative to an insertion direction of the position assuring member.

2. The connector of claim 1, wherein the position assuring member is fastened to the housing lock in a primary locking state and a secondary locking state in which the position assuring member locks a cable terminal in the cable inserting hole.

3. The connector of claim 1, wherein a longitudinal direction of the housing lock extends along the insertion direction of the position assuring member.

4. The connector of claim 2, wherein the housing lock is cantilever-shaped.

5. The connector of claim 4, wherein one end portion of the housing lock is fixed to a side of the housing body adjacent the coupling space.

6. The connector of claim 5, wherein another end portion of the housing lock is a free end.

7. The connector of claim 6, wherein the cable inserting hole of the housing body is a first cable inserting hole and the position assuring member has a second cable inserting hole extending though the sliding body.

8. The connector of claim 7, wherein the housing lock has a locking protrusion extending into the coupling space.

9. The connector of claim 8, wherein the locking protrusion is provided in a shape which forms an obtuse angle in a front portion and an acute angle in a rear portion relative to an inserting direction of the position assuring member.

10. The connector of claim 9, wherein the action portion has a fixing protrusion provided in a shape which forms an obtuse angle in a front portion and an acute angle in a rear portion relative to the inserting direction of the position assuring member.

11. The connector of claim 10, wherein the action portion has a cover configured to cover the free end.

12. The connector of claim 7, wherein the action portion engages the housing lock at each of a first inserting length corresponding to the primary locking state and a second inserting length of the position assuring member corresponding to the secondary locking state.

13. The connector of claim 12, wherein the second inserting length is greater than the first inserting length.

14. The connector of claim 13, wherein, when the position assuring member is at the first inserting length, a locking protrusion provided in the housing lock is disposed between a pair of action protrusions provided in the action portion, and the first cable inserting hole overlaps the second cable inserting hole.

15. The connector of claim 14, wherein, when the position assuring member is at the second inserting length, the locking protrusion is aligned with the pair of action protrusions, and the first cable inserting hole overlaps the second cable inserting hole such that at least a portion of the first and second cable inserting holes are misaligned.

16. The connector of claim 15, wherein, when the position assuring member is at a third inserting length between the first and second inserting lengths, the locking protrusion abuts a slope formed in one of the pair of action protrusions, and a bending portion of the housing lock is bent toward an outer side of the coupling space.

* * * * *